United States Patent [19]

Gray

[11] 4,004,793

[45] Jan. 25, 1977

[54] DUAL HOLDING FURNACE

[75] Inventor: Ronald D. Gray, Bethel Park, Pa.

[73] Assignee: Leotromelt Corporation, Pittsburgh, Pa.

[22] Filed: Mar. 31, 1975

[21] Appl. No.: 563,843

[52] U.S. Cl. ..... 266/236; 164/322

[51] Int. Cl.[2] ..... C21C 5/42

[58] Field of Search ..... 266/33 R, 33 S, 34 R, 266/38, 39, 42, 13, 40, 236, 237, 239, 240; 164/133, 135, 136, 281, 322, 337; 222/DIG. 4, DIG. 5, DIG. 15

[56] References Cited

UNITED STATES PATENTS

| | | | |
|---|---|---|---|
| 1,554,367 | 9/1925 | Rackoff | 266/38 |
| 2,039,738 | 5/1936 | Pugh | 266/13 |
| 2,054,921 | 9/1936 | Betterton | 266/38 |
| 2,218,171 | 10/1940 | Junghans | 164/322 |
| 2,481,433 | 9/1949 | McBroom | 266/38 X |
| 3,201,224 | 8/1965 | Grim | 266/34 R X |
| 3,567,205 | 3/1971 | Armour et al. | 266/38 X |
| 3,655,176 | 4/1972 | Winkler et al. | 266/38 |
| 3,685,573 | 8/1972 | Domres et al. | 266/38 X |
| 3,737,153 | 6/1973 | Steffora et al. | 266/38 |

FOREIGN PATENTS OR APPLICATIONS

| | | | |
|---|---|---|---|
| 488,507 | 12/1952 | Canada | 266/39 |
| 605,953 | 8/1948 | United Kingdom | 222/DIG. 15 |

*Primary Examiner*—Gerald A. Dost
*Attorney, Agent, or Firm*—Fred Wiviott

[57] ABSTRACT

An enclosed refractory lined furnace vessel has spaced apart refractory lined pouring chambers extending laterally from the lower end of the furnace body. Molten metal flows from the vessel to the chambers through flow passages and each chamber has a drain hole in its bottom which may be opened and closed by a stopper rod so that molten metal may be discharged into molds that are transported under the vessel by spaced conveyors. A receiving spout for molten metal has an inlet above the molten metal surface in the vessel and an outlet below the surface, thereby sealing the furnace from the atmosphere and enabling adding metal to the vessel without opening it or tilting it. An electrically resistive graphite rod extends across the interior of the furnace for maintaining its interior at a desired temperature.

12 Claims, 6 Drawing Figures

DUAL HOLDING FURNACE

BACKGROUND OF THE INVENTION

This invention relates to a furnace for holding molten metal that is to be cast into molds. Such furnaces are usually sealed when holding molten metal in readiness for casting and an inert atmosphere or vacuum may be maintained in the furnace so that the analysis of the melt does not fade. A source of heat may also be provided in the furnace for maintaining the melt at the desired temperature for casting. Conventional holding furnaces include means for discharging metal into a mold or into a series of molds that are conveyed adjacent to or beneath the furnace. Such furnaces were restricted to serving a single conveyor line.

SUMMARY OF THE INVENTION

A general object of this invention is to provide a holding furnace for supplying molten metal to more than one conveyorized line of molds and for pouring the molds in rapid sequence.

A further object is to provide a holding furnace with spaced apart metal accumulating chambers that extend over transported mold lines and are subject to being drained individually so that while a mold in one line is being poured, the other may be advanced.

A still further object is to provide for transporting the molds at a level generally below the level of the furnace rather than along the sides thereof so that floor space may be conserved and the overall size of the installation may be reduced.

Yet another object of the invention is to mount the furnace for being shifted to a limited degree with respect to the transported molds so that exact alignment can be obtained between the outlets of the pouring chambers and the inlets of the molds.

In general terms, the invention is characterized by an enclosed refractory lined furnace vessel. The interior bottom of the refractory lining has radially extending openings each of which communicates with one of a pair of pouring chambers that are mounted on the exterior of the furnace. The pouring chambers each have selectively operable valves comprising a movable stopper rod and a seat below which there is an opening for molten metal to discharge. The chamber openings are disposed over the mold conveyor lines so that more than one line can be served by the same furnace.

How the objects of the invention set forth above and other specific objects are achieved will be evident in the more detailed description of an illustrative embodiment of the invention which will now be set forth in reference to the drawings.

DESCRIPTION OF A PREFERRED EMBODIMENT

Figure 1:
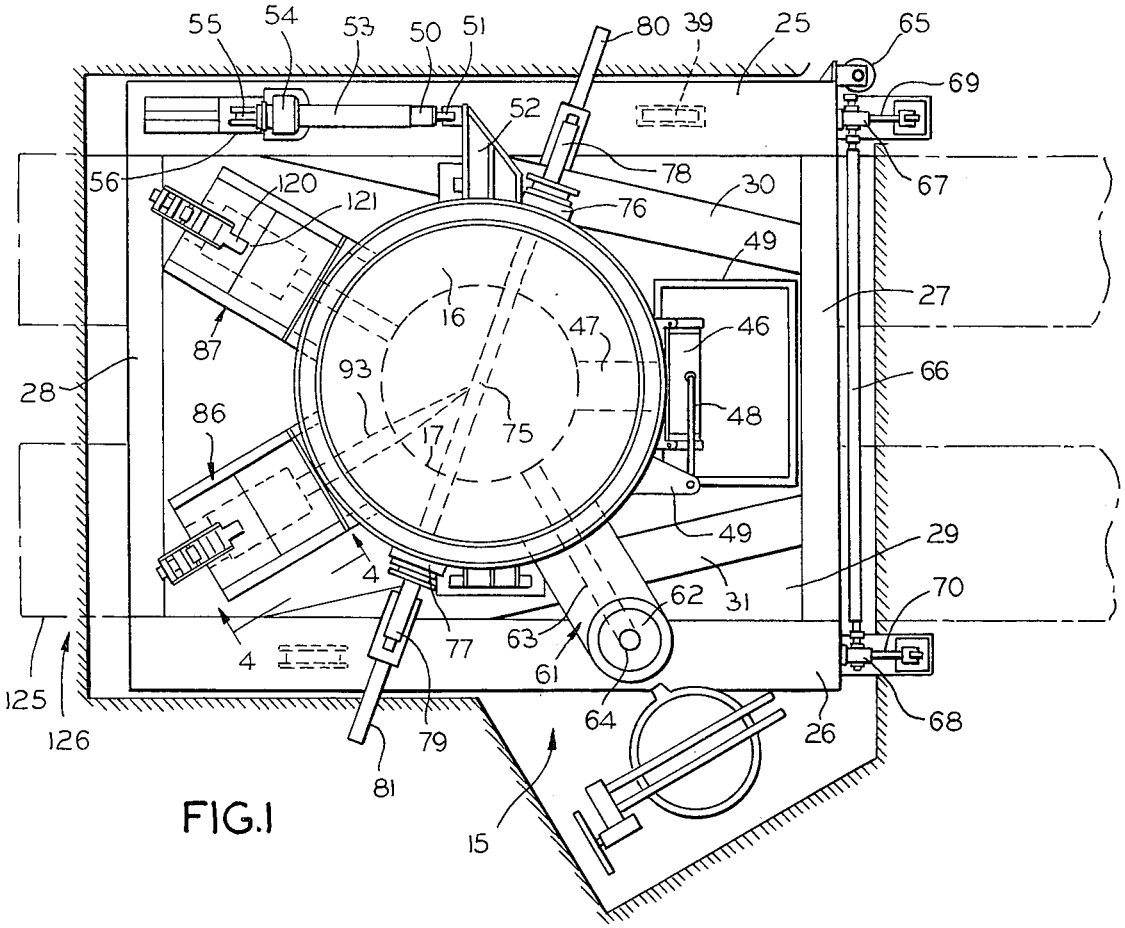
FIG. 1 is a plan view of a holding furnace constructed in accordance with the invention.

Referring to the drawings, the holding furnace comprises a cylindrical metal shell 10. Welded to diametrically opposite sides of the shell are rib structures 11 which have curved rocker segments 12 fastened to their lower ends. A curved rocker segment may have teeth in its periphery which mesh with teeth on a straight toothed rack 13. The rack is on top of a stand 14 which is mounted on the base frame 15. Curved segment 12 supports the furnace and permits tilting it within limits.

Figure 2:
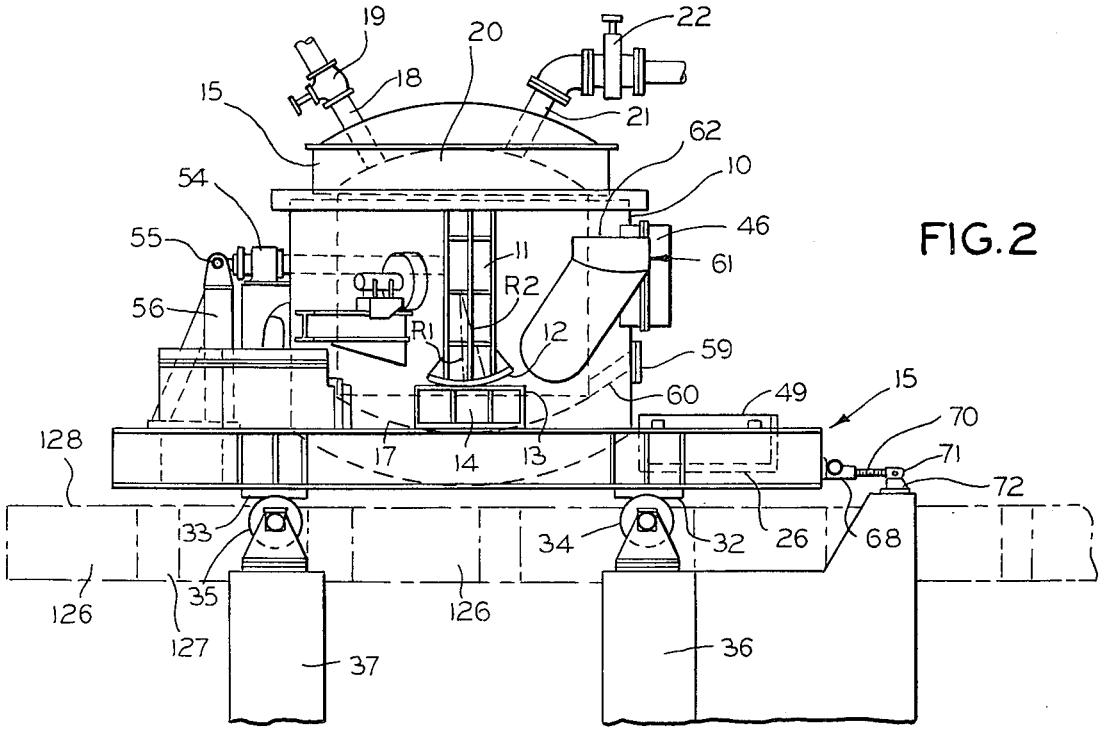
FIG. 2 is a side elevation of the furnace.

Two radii of curved rocker segment 12 are indicated by dashed lines marked R1 and R2 in FIG. 2. These radii originate from a common point on the vertical center plane of the furnace. Radius R2 is greater than R1 which results in the bottom of the furnace rising when the furnace is back-tilted or rocked clockwise as it appears in FIG. 2. This rise compensates to a large extent for the downward movement of the back end of the furnace bottom which would otherwise occur due to rocking and striking of molds, to be discussed later, passing under the furnace is avoided.

The furnace is provided with a refractory lined cover assembly 15. The cover makes a substantially gas tight seal with the furnace body. Shell 10 has a hollow cylindrical interior wall lining 16 of refractory material and a dish shaped refractory lined bottom 17. The arched cover 15 of the furnace may have various inlets and outlets for introducing and removing gases and materials. For example, a pipe 18 penetrating cover 15 is provided with a valve 19 for controlled introduction of gas, which may be reactive or merely inert, at a positive pressure for excluding atmospheric air from the hollow interior 20 of the furnace. Another pipe 21 extending through cover 15 may be provided with a valve 22 which may be connected to a vacuum pump, not shown, so that a subatmospheric pressure may be maintained in the furnace if desired.

Base frame 15 which supports the furnace has two side members 25 and 26 that are joined with a pair of spaced apart end members 27 and 28. Members 25–28 form a rectangular frame 15 which has substantial open space 29 within its perimeter as can be seen in FIG. 1. Frame 15 is stiffened with reinforcing members 30 and 31 which are welded or otherwise rigidly fastened at their ends to the sides and an end member of base frame 15.

Figure 3:
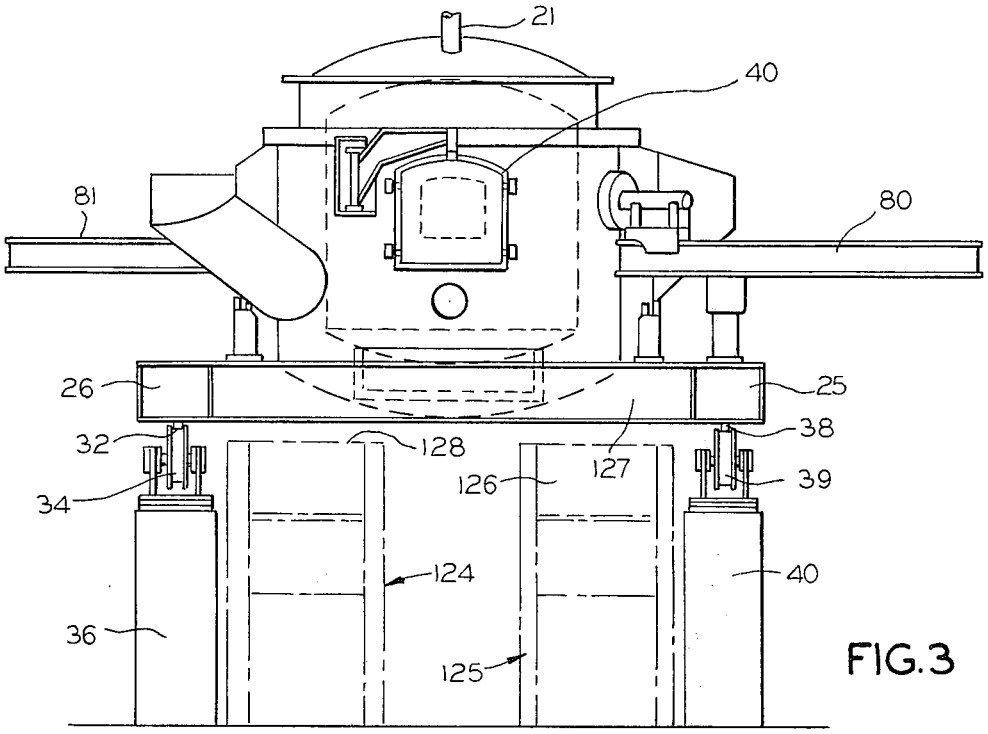
FIG. 3 is a rear elevation of the furnace.

As shown in FIG. 2, short straight track members 32 and 33 are fastened to the lower edges of side member 26 of frame 15 and these tracks run on flanged wheels 34 and 35, respectively, which are journaled for rotation on supporting columns 36 and 37. Side frame member 25, opposite from member 26, also has track members such as 38 as can be seen in FIG. 3 and wheels such as 39 are journaled for rotation on columns 40. By virtue of being mounted on wheels, base frame 15 and the furnace mounted thereon are movable jointly in a longitudinal direction to a limited degree. This is for obtaining accurate alignment with the molten metal discharge holes of the furnace and the molds which are conveyed under the furnace.

The rear of the furnace is provided with a swingable door 46 that provides access to the interior of the furnace for inspecting the molten metal therein and for deslagging the surface of the molten metal. As can be seen in FIG. 1, door 46 cooperates with a hole 47 through the refractory wall lining 16 and the metal furnace shell 10. The door is swingable on a hinge arm 48 which is carried on a bracket 49 that is mounted to the shell of the furnace as shown in FIG. 1. To deslag the molten metal, the furnace may be tilted rearwardly through a small angle and the slag scraped out through the opened door 46. A removable slag box 49 may be used to catch the slag that is removed.

The furnace may be tilted on rockers 12 from a position where its cylindrical axis is vertical to various positions wherein its axis is at an angle with respect to vertical. In this example, the power operated tilting means, which are especially visible in FIG. 1, comprises a lead screw 50 that is pivotally connected at 51 to an arm 52 which is fastened to the furnace body and extends laterally of the furnace. Screw 50 is engaged in an internally threaded rotatable sleeve 53 which is subject to rotation under the influence of a motor 54. This may be an electric or a hydraulic motor. The motor is on a support that is pivotally connected at 55 to a column 56. Rotation of internally threaded sleeve 53 in one direction causes the furnace to tilt rearwardly on rockers 12 to assume an angular attitude, whereas rotation in the other direction restores it to its vertical attitude. Later, there will be a discussion of the FIGS. 5 and 6 embodiments of the furnace wherein tilting takes place on a horizontal pivot axis located near the rear or slag door side of the furnace which may be aptly characterized as a reverse nose tilt system in contradistinction to typical nose tilt furnaces which pivot on an axis located near the pouring or discharge end of the furnace.

As can be seen in FIG. 2, beneath deslagging door 46 the furnace is provided with a plug 59 that aligns with a duct 60 through the interior furnace wall. The duct is angulated downwardly toward the dish shaped bottom of the furnace. Plug 59 may be removed and the furnace may be angulated to permit emptying any residual material from the furnace.

The furnace is provided with a spout 61, called a receiving spout, through which molten metal may be poured into the furnace. The spout 61 has a refractory lining 62 defining a channel 63 for the molten metal to run from its inlet 64 to the dish shaped bottom 17 of the furnace. The inlet 64 to the receiving spout is well above the highest expected level of molten material in the furnace and the inlet remains above this level even though the furnace is tilted through a limited angle so the contents of the furnace cannot exit from the receiving spout.

Means are provided at the rear of the furnace for moving base frame 15 selectively in longitudinal directions on wheels such as 34 and 35. The frame shifting means can be readily seen in FIGS. 1 and 2 to comprise a combination motor and speed reduction unit 65 that drives a cross shaft 66. At each end of the cross shaft 66 there are housings 67 and 68 which contain pinions driven by the cross shaft. The pinions engage with toothed racks 69 and 70. A typical rack 70 is pivotally connected at 71 to a stationary bracket 72. Rotation of cross shaft 66 in opposed directions, shifts base frame 15 and the furnace thereon rearwardly and forwardly in a longitudinal direction. Of course, now that shifting the furnace has been suggested, it will become evident to those skilled in the art that shifting may be accomplished with other mechanisms or with hydraulic or pneumatic cylinders, not shown.

Extending across the interior of the furnace at a level above the highest expected level of the molten contents therein is a heating rod 75, preferably composed of graphite. This rod passes through insulating glands 76 and 77 on diametrically opposite sides of the furnace. Opposite ends of rod 75 are supported in carriages 78 and 79 on the outside of the furnace. The carriages are on long and short tracks 80 and 81, respectively, so that they can be retracted for replacing the heating rod when it breaks or has become too thin due to vaporization of graphite. The means for conducting electric current through the rod for heating it are not shown.

In accordance with the invention, at least two molten metal pouring chambers 86 and 87 extend radially from the furnace body as can be seen particularly well in FIG. 1. Pouring chambers 86 and 87 diverge from each other on opposite sides of a vertical longitudinal median plane extending through the furnace. Since these chambers are similar, only one chamber 86 will be described in detail, primarily in reference to FIGS. 1 and 4–6.

Pouring chamber 86 is essentially a metal box 88 having a cover 89. The box is fastened to the furnace shell 10. The interior walls 90 and the bottom 91 of the chamber are lined with refractory material. The top plane 92 of the chamber bottom is at about the same level as the bottom of a channel 93 which extends from the chamber to the dish shaped bottom 17 of the furnace. Channel 92 is of sufficient depth to permit substantially all of the molten material within the furnace to flow to the interior of chamber 86 without tilting the furnace if desired. The bottom of the pouring chamber has a hole 94 to enable discharging molten material from chamber 86. A stopper 95 has a lower tip 96 which is adapted to seat in discharge opening 94 so as to preclude drainage of molten material from the chamber. Stopper 95 is retractable vertically, as shown, to unseat tip 96 and permit drainage of molten material from the chamber. The stopper 95 may comprise a refractory coated elongated metal member. Stopper 95 extends through chamber cover 89 where it is engaged with an operating mechanism that is generally designated by the reference number 100.

The stopper rod operating mechanism 100 may be of any well known type which is adapted for moving the stopper rod 95 vertically so its lower end moves into and out of engagement with the discharge opening. For example, the operating mechanism 100 may include a double acting hydraulic cylinder mounted vertically on one side of a support 102 affixed to the side of the pouring chamber 86. A piston rod 104 extends upwardly from the piston 101 and is pivotally connected at its upper end to a pair of parallel horizontally extending links 105 whose other ends are pivotally connected to the base of a bracket member 106 affixed to the upper end of rod 95. In addition links 105 are also pivotally connected intermediate their ends to a vertically extending post 106 whose lower end is affixed to support 102. A second pair of links 110 extend in general parallelism with links 105 and are pivotally connected at their opposite ends to the upper ends of bracket 106 and post 108.

Figure 4:
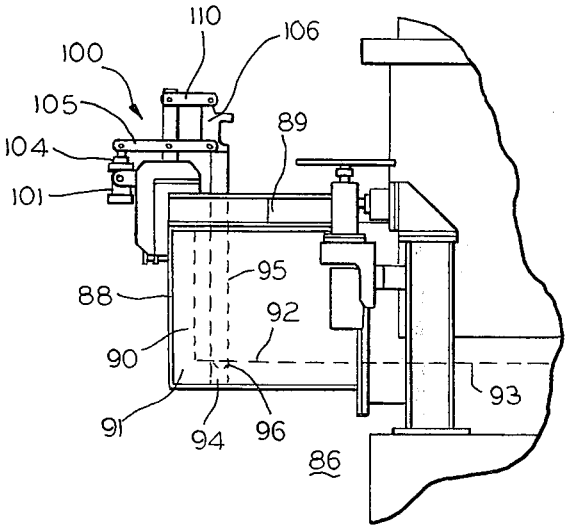
FIG. 4 is a side elevation of the pouring chamber of the furnace, isolated therefrom as viewed along the line 4—4 in FIG. 1.

It will be appreciated that when cylinder 101 is pressurized in a first direction so as to move rod 104 downwardly the links 105 and 110 will pivot counterclockwise as viewed in FIG. 4 to move stopper rod 95 vertically upwardly to permit the discharge of molten metal from opening 94. When cylinder 101 is thereafter pressurized in an opposite direction, rod 95 will be moved downwardly to close opening 94.

The second pouring chamber 87 has a stopper rod 120 cooperating with a drain or pouring hole 121. The operating mechanism for stopper rod 120 is essentially the same as the mechanism 100 which has just been described.

Pouring chambers 86 and 87 are for discharging molten metal into molds that are conveyed underneath the furnace and the pouring chambers. The conveyor systems for conveying molds in two separate lines under the furnace are shown schematically. In FIG. 3, the conveyors are designated generally by the reference numbers 124 and 125. The conveyors transport a series of molds 126 which have metal receiving openings 127 which are laterally spaced apart a distance equal to the distance between openings 94 or 124 in chambers 86 and 87, respectively. The molds are also spaced apart in the direction of conveyor travel as shown in FIG. 1. As seen in FIG. 3, molds 126 on conveyor line 125 pass under pouring chamber 86 and that molds 126 on conveyor 124 pass under pouring chamber 87. As is evident in FIGS. 2 and 3, the top surfaces 128 of molds 126 pass under support frame 15 with some clearance. When holes 94 and 121 in the respective pouring chambers 86 and 87 are vertically aligned with the inlet holes 127 to the molds, the stoppers can be raised to permit molten metal to flow from the pouring chambers to the molds.

The molds are preferably moved on each conveyor in a step-by-step fashion out of phase with each other. Typically, one of the conveyors such as 125 advances an unfilled mold one step to where the mold is under pouring chamber 86, for instance. After a slight pause, stopper rod 95 is raised to permit molten metal to flow from the pouring chamber to the mold. The rod then moves down and the conveyor steps again. When conveyor line 125 is advancing a mold into molding position or away from it, the other conveyor line 124 has positioned a mold under the other chamber 87 and at this time its stopper rod 127 is lifted to fill the mold. This alternate stepwise operation of the conveyor lines may be continued indefinitely since additional molten metal can be introduced into the furnace through receiving spout 61 even though the pouring chambers are in continual use. The stopper rods 95 may be opened and closed by an operator who manually pressurizes cylinders 101 or by an interlock which is coupled to the conveyor stepping apparatus and which opens and closes the stopper rods for predetermined intervals for pouring measured amounts of metal in the respective molds.

The drain holes 96 and 121 on the bottom of the respective pouring chambers 86 and 87 can be established in perfect vertical alignment with the metal receiving holes in the molds by shifting the entire furnace with respect to the conveyor line. The shifting mechanism involving the operation of cross shaft 66 has been described hereinabove.

In an emergency such as when the stoppers of the pouring chambers leak, or when it is desired to empty the furnace or to deslag it, all of the molten material can be quickly removed from the pouring chamber by tilting the furnace by actuation of the tilting apparatus which was described earlier.

It will be understood that the conveyor is interlocked with a stopper operating mechanism so that the stoppers open automatically when the molds are in proper alignment with the pouring chambers.

Figure 5:
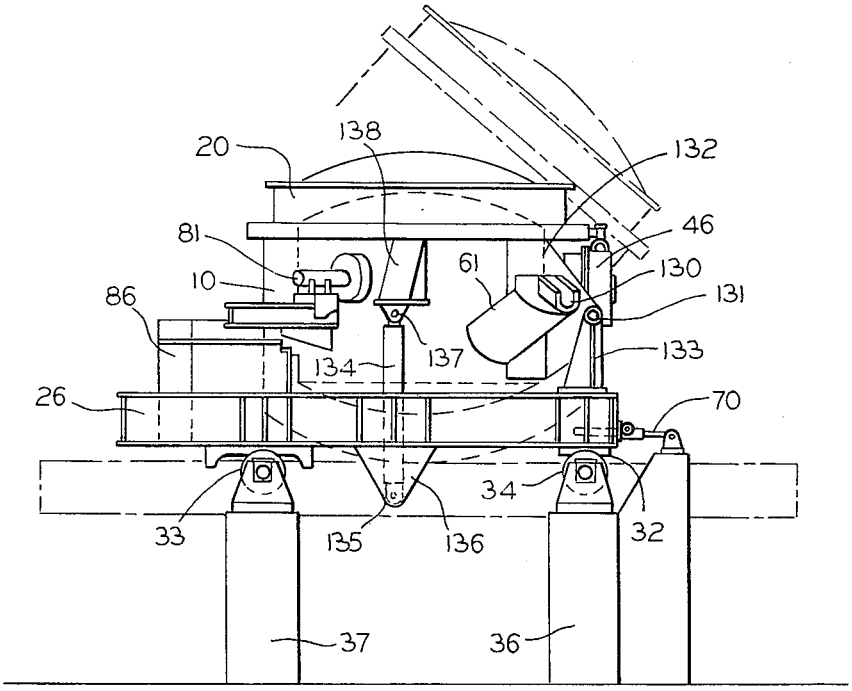
FIG. 5 is a side elevation of an alternative embodiment of the furnace having a modified tilting mechanism.

FIG. 5 is a side elevation view of an embodiment of the furnace which is characterized as a reverse nose tilting system. Components which correspond with components in the FIGS. 1-4 embodiment are given the same reference numbers. The furnace is used for pouring molds suquentially as with the previously discussed embodiment. The furnace in FIG. 5 comprises a refractory lined metal shell 10 with a cover 20 and a heating rod 81. One of the pouring boxes 86 is evident and it is similar to the pouring boxes 86 and 87 in the previous embodiment except that in this view the stopper rod and its operating mechanism has been omitted for the sake of brevity. The furnace also has a molten metal receiving spout 61, which in this embodiment, is modified to include an auxiliary spout 130 for pouring molten material out of the furnace if desired when the furnace is tilted sufficiently as suggested by its phantom line position. The furnace has a slag removal door 46 at its rear. As in the previous embodiment, the furnace may be mounted on a frame, one side member 26 of which is evident. The frame may be supported on rollers such as 33 and 34 which are mounted on columns 37 and 36, respectively.

In the FIG. 5 embodiment, the furnace body 10 is reversely tiltable on horizontal-pivot shafts such as 131 which are located adjacent slag door 46 at the rear of the furnace. The shafts 131 extend from brackets such as 132 which extend from opposite sides of the furnace and the shafts are journaled with respect to a pair of posts such as 133 which are mounted on the longitudinally shiftable furnace supporting frame. It will be evident that when the furnace body is tilted clockwise from the position in which it is shown in FIG. 5, its rear or slag door will not descend but the furnace bottom extending to pouring box 86 will rise. This prevents collision between the furnace and molds passing under it when it is tilted for any reason such as to retract molten metal from pouring box 86 or to remove slag from slag door 46.

In this example, the furnace is tilted with a pair of pneumatic or hydraulic work cylinders one of which, 134 is visible in FIG. 5. There is a corresponding cylinder on the other side of the furnace body. One end of the extensible work cylinder is pivotally connected at 135 to a bracket 136 which is fastened to frame member 26. The other end of cylinder 134 is pivotally connected at 137 to a bracket 138 which is fastened to furnace shell 10. It will be evident that when cylinder 134 is pressurized, the furnace body will tilt clockwise about rear pivot 131 and the nose end or the end that has pouring box 86 affiliated with it will rise.

Figure 6:
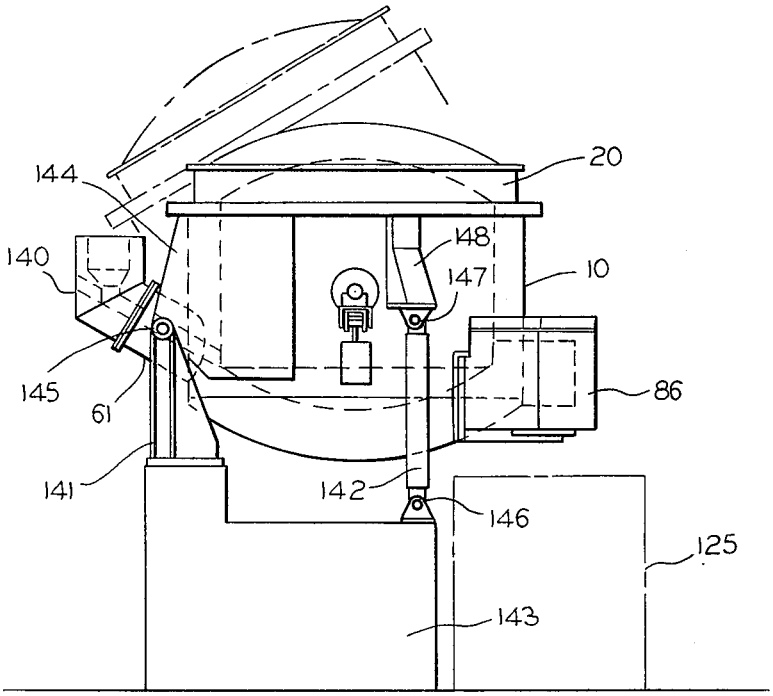
FIG. 6 is a side elevation of an alternative embodiment of the furnace having a modified support mechanism.

FIG. 6 is a side elevation view of another embodiment of the furnace with the reverse nose tilt feature. The furnace in FIG. 6 is generally like the embodiments of FIGS. 1–5 and similar parts are given the same reference numbers. The furnace in FIG. 6 comprises a refractory lined metal shell 10 and a cover 20. There is also a pouring box 86 which is similar to its counterparts in the preceding embodiments but the pouring box stopper and its operating mechanism are omitted for the sake of brevity. The furnace also has a hot metal receiving spout 61 which differs from its counterparts in the preceding figures by inclusion of a drain hole 140 which is adapted to be unplugged to permit discharge of slag or other contents of the furnace when it is reverse tilted.

In the FIG. 6 embodiment, the furnace is not mounted on a longitudinally shiftable frame, but instead, is supported on a pair of brackets, one of which, 141, is visible in FIG. 6, and it is also further supported on a pair of hydraulic or pneumatic cylinders such as 142. The brackets and cylinders are mounted on a foundation 143.

A pair of brackets such as 144 are fastened to furnace body 10 and extend outwardly therefrom on opposite sides of spout 61. Furnace brackets 144 make a pivotal connection at 145 with stationary brackets 141 so that the furnace body 10 may pivot or tilt about and above a horizontal pivot axis. During normal mold pouring operations, the axis of cylindrical furnace body 10 is vertical and molten metal may drain out of the bottom of pouring box 86 if its stopper rod, not shown, is retracted. The furnace body may be tilted reversely or counterclockwise by pressurizing work cylinder 142 and thereby extending it. The piston end of cylinder 142 is pivotally attached at 146 to foundation 143 and the other end of the cylinder is pivotally attached at 147 to a bracket 148 which is fastened to furnace body 10. It will be evident that when cylinder 142 is actuated, the furnace will pivot about its rear end axis 145 and the pouring box will rise but no part of the furnace will descend so as to avoid interference with any molds which may be positioned for pasing under the furnace and its associated pouring boxes such as 86.

One mold line is symbolized in FIG. 6 by the block 125 in phantom lines and is arranged to convey molds along the plane of the drawing to the forefront of foundation 143 and under pouring box 86. Another parallel mold line, not visible, at the rear of foundation 143, conveys molds under a pouring box similar to 86.

Although various embodiments of the new holding furnace with multiple pouring outlets and reverse nose tilting have been described in detail, such description is intended to be illustrative rather than limiting, for the invention may be variously embodied and it is to be limited only by interpretation of the claims which follow.

I claim:

1. A holding furnace comprising a vessel including a refractory shell defining a first space for containing molten material, cover means enclosing said space, support means for supporting said vessel in an elevated position above a conveyor space, a plurality of refractory lined pouring chambers extending from one side of said vessel in spaced apart relation, each of said chambers communicating with said first space adjacent the lower end thereof, each of said chambers having a bottom with an opening formed therein, said openings being disposed for draining molten material from said chambers into molds located beneath said vessel, a plurality of stopper means respectively mounted for movement into and out of an opened and closed position relative to said openings, operating means for individually operating said stopper means to selectivity open said openings for draining said molten material from said chambers and to close said openings for interrupting said draining of material, a plurality of conveyor means disposed below said vessel and in said conveyor space and one passing beneath each chamber for positioning molds consecutively under each of said openings.

2. The apparatus of claim 1 wherein there are a pair of said pouring chambers of substantially equal length and each extends generally radially from said vessel and diverge from each other on opposite sides of a longitudinal plane passing through said vessel, the openings in said chamber bottoms are radially spaced from said body to thereby establish said openings with the desired lateral spacing between them, said conveyor means extending generally parallel each other.

3. The apparatus set forth in claim 1 wherein said support means includes tilt means supporting said vessel for tilting movement about an axis adjacent the other side of said vessel to elevate the one side of said vessel without substantially depressing said other side so that molten metal may be drained from said chambers without moving said vessel downwardly into the molds on said conveyor means.

4. A holding furnace comprising a vessel including a refractory shell defining a space for containing molten material, cover means enclosing said space, a pair of refractory lined pouring chambers extending from one side of said vessel in spaced apart relation, each of said chambers communicating with said space adjacent the lower end thereof, each of said chambers having a bottom with an opening formed therein, said openings being disposed for draining molten material from said chambers into molds located beneath said vessel, a plurality of stopper means respectively mounted for movement into and out of an opened and closed position relative to said openings, operating means for individually operating said stopper means to selectively open openings for draining said molten material from said chambers and to close said openings for interrupting said draining of material, a plurality of conveyor means disposed below said vessel and one passing beneath each chamber for positioning molds consecutively under each of said openings, tilt means eccentrically supporting said vessel for tilting movement to elevate the one side of said vessel without substantially depressing the other side thereof so that molten metal may be drained from said chambers without moving said vessel downwardly into the molds on said conveyor means, said chambers extending generally radially from said vessel and adjacent one side thereof and a slag opening formed on the opposite side of said vessel whereby elevation of said chambers will cause slag to flow outwardly of said slag opening, and a receiving spout mounted on said vessel between said slag opening and one of said chambers.

5. The apparatus in claim 4 including a base for supporting said vessel, support means for supporting said base, and means for shifting said base relative to said support means to thereby enable alignment of said pouring chamber openings with said molds.

6. The apparatus as in claim 4 wherein said spout for receiving said molten material and for conducting said material to said space includes an inlet above the expected level of said molten material in said space and an outlet below said level whereby a substantially gas tight seal is effected in said outlet by said molten material.

7. The apparatus as in claim 6 including an electrically resistive heating rod extending across said space at a level above the expected level of molten material that is to be contained in said space.

8. The apparatus set forth in claim 7 including:

a base for supporting said furnace body, said means for tilting said body being supported on said base, and support means for said base and means for shifting said base relative to said support means to thereby enable alignment of said pouring chamber openings with said molds.

9. A holding furnace comprising a vessel including a refractory shell defining a space for containing molten material, cover means enclosing said space, a plurality of refractory lined pouring chambers extending from one side of said vessel in spaced apart relation, each of said chambers communicating with said space adjacent the lower end thereof, each of said chambers having a bottom with an opening formed therein, said openings being disposed for draining molten material from said chambers into molds located beneath said vessel, a plurality of stopper means respectively mounted for movement into and out of an opened and closed position relative to said openings, operating means for individually operating said stopper means to selectively open openings for draining said molten material from said chambers and to close said openings for interrupting said draining of material, a plurality of conveyor means disposed below said vessel and one passing beneath each chamber for positioning molds consecutively under each of said openings, tilt means supporting said vessel for tilting movement to elevate the one side of said vessel so that molten metal may be drained from said chambers, and a slag opening formed on the opposite side of said vessel whereby elevation of said chambers will cause slag to flow outwardly of said slag opening, and a receiving spout mounted on said vessel between said slag opening and one of said chambers.

10. The apparatus of claim 9 wherein there are a pair of said pouring chambers and each extends generally radially from said vessel and diverge from each other on opposite sides of a longitudinal plane passing through said vessel, the openings in said chamber bottoms are radially spaced from said body to thereby establish said openings with the desired lateral spacing between them, said conveyor means extending generally parallel with each other.

11. The apparatus as in claim 9 wherein said spout for receiving said molten material and for conducting said material to said space includes an inlet above the expected level of said molten material in said space and an outlet below said level whereby a substantially gas tight seal is effected in said outlet by said molten material.

12. The apparatus set forth in claim 11 including:

a base for supporting said furnace body, said means for tilting said body being supported on said base, and support means for said base and means for shifting said base relative to said support means to thereby enable alignment of said pouring chamber openings with said molds.

* * * * *